US006379461B1

(12) United States Patent
Masumoto

(10) Patent No.: US 6,379,461 B1
(45) Date of Patent: Apr. 30, 2002

(54) COATING TOOL

(75) Inventor: Hiroaki Masumoto, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 09/578,230

(22) Filed: May 24, 2000

(30) Foreign Application Priority Data

May 28, 1999 (JP) ..... 11-149056

(51) Int. Cl.[7] ..... B05C 17/10

(52) U.S. Cl. ..... 118/76; 118/200; 118/257; 156/577; 156/579

(58) Field of Search ..... 118/76, 200, 257; 156/577, 579; 400/695, 696, 700

(56) References Cited

FOREIGN PATENT DOCUMENTS

EP 0362697 A 4/1990
JP 4-126878 11/1992
WO WO99/01368 A 1/1999

*Primary Examiner*—Laura Edwards
(74) *Attorney, Agent, or Firm*—Butler, Snow, O'Mara, Stevens & Cannada, PLLC

(57) ABSTRACT

A coating tool is provided which is adapted to transfer a paste or a correcting paint from a transfer tape to a target object. The coating tool comprises a main body housing therein a supply reel and a supply reel gear, supported by a first shaft, and a take-up reel and a take-up reel gear, supported by a second shaft. According to one embodiment of the present invention the coating tool includes an annular rib formed on the cylindrical portion of the supply reel gear and an elastic edging strip, for holding and engaging the supply reel gear, formed on the inner wall surface of the engagement hole of the supply reel and positioned between the annular rib and the supply reel gear. Accordingly, the delivery and taking-up of the transfer tape can be performed smoothly and securely without the thermal deformation of the elastic edging strip.

4 Claims, 2 Drawing Sheets

COATING TOOL

BACKGROUND OF THE INVENTION

1. Field of the Invention

The present invention relates generally to coating tools, and more particularly, to a shafting structure for a coating tool adapted to transfer to a target object a paste, correcting paint or the like, which is adhered to the surface of a transfer tape.

2. Related Art conventional coating tools are known which perform a coating operation by transferring a paste or a correcting paint adhered to the surface of a transfer tape, to a target object. Such conventional coating tools typically include supply and take-up reel gears which mesh with one another, and supply and take-up reels which are mounted on the same shaft as the supply or take-up reel gear, respectively, for integral rotation therewith relative to the corresponding mounting shaft. A problem which may occur with coating tools of this general type is that the transfer tape may break or be cut when unused transfer tape is drawn out with a suitably strong tensile force so that only the supply reel rotates and an excessive degree of stress is applied to the transfer tape. In order to overcome this problem the supply reel and the supply reel gear of conventional coating tools have typically been made integral with each other in such a manner that the supply reel gear is held clamped by an elastic edging strip formed on the inner wall surface of the engagement hole of the supply reel, whereby the supply reel rotates idly with respect to the supply reel gear when the tensile force applied to the transfer tape overcomes the frictional force exerted between the supply reel and supply reel gear.

When the unused transfer tape is drawn out with a strong tensile force, the supply reel and the supply reel gear begin to rotate integrally and when the rotational speed exceeds a predetermined value, such that the frictional force generated between the supply reel and the supply reel gear via the elastic edging strip disposed therebetween is overcome, the supply reel does not rotate integrally with the supply reel gear. Instead the supply reel rotates idly with respect to the supply reel gear. Consequently, the supply reel gear stops rotating while the unused transfer tape is drawn out. Furthermore, the take-up reel gear, which meshes with the supply reel gear, and the take-up reel which is mounted on the same shaft as the take-up reel gear, also do not rotate. Accordingly, no excessive degree of stress is applied on the transfer tape delivered from the supply reel, thereby preventing such inconvenience as the breakage or cutting of the transfer tape.

However, such conventional coating tools of the type previously described are subject to the following disadvantage. Since the elastic edging strip formed on the inner peripheral wall surface of the engagement hole of the supply reel, for the purpose of causing the supply reel and the supply reel gear to rotate integrally with one another, is made of a thin or soft material making it elastic, the edging strip may become deformed when it is stored, transported or used in a high-temperature environment for a prolonged period of time. More particularly, the elastic edging strip may become deformed in such a manner that it expands outwardly and fails to hold the cylindrical top portion of the supply reel gear securely so that sometimes the phenomenon of idling takes place between the supply reel and the supply reel gear, thereby preventing the supply reel and the supply reel gear from rotating integrally with one another. The foregoing idling between the supply reel and the supply reel gear due to deformation of the elastic edging strip is undesirable and sometimes causes the transfer tape to be tangled inside and outside of the main body of the coating tool or may also result in an overflow of excess transfer tape accumulating outside the main body of the coating tool since the take-up reel is unable to take up the waste tape passing over the printer head of the coating tool. This is the case since the take-up reel gear meshes with the supply reel gear and the take-up reel is integral with the take-up reel gear.

Thus, what is meant by the above-described disadvantage is that in the case of the take-up reel which is integral with the take-up reel gear meshing with the supply reel gear and adapted to take up the transfer tape which has become unavailable or wasted due to its passage over the printer head, it is not possible to take up the waste tape to a length corresponding to the length of the unused transfer tape due to the idle rotation of the supply reel with respect to the supply reel gear and consequently, there sometimes takes place such inconvenience as the entanglement of the transfer tape inside and outside the main body of the coating tool or the overflowing of the transfer tape from the main body of the coating tool.

SUMMARY OF THE INVENTION

The present invention is provided as a solution to the previously discussed problems associated with conventional coating tools. An object of the present invention is to provide a coating tool which is simple in structure and is capable of performing the delivery and take-up of transfer tape smoothly and accurately. This is accomplished in such a manner that a supply reel, a take-up reel, a supply reel gear and a take-up reel gear are arranged within the body of the tool so as to allow the supply reel to rotate integrally with the supply reel gear, and to allow the takeup reel to rotate integrally with the take-up reel gear. Furthermore, the coating tool of the present invention prevents the idle rotation of the supply reel with respect to the supply reel gear due to the thermal deformation of the component parts of the coating tool, thereby overcoming the previously discussed problem with conventional coating tools. Additionally, the coating tool of the present invention does permit the idle rotation of the supply reel relative to the supply reel gear when an excessive tensile force is applied to the correction tape, with idle rotation of the supply reel being desirable in this instance so as to prevent the breakage or cutting of the transfer tape.

In order to achieve the foregoing advantages, the coating tool according to one embodiment of the present invention comprises a main body having a printer head projecting outwardly from an opening formed at the top end thereof. The main body of the coating tool receives a supply reel therein, with the supply reel including an engagement hole supported by a supply reel shaft and being adapted to deliver an unused transfer tape having a paste or a correcting paint applied thereon, to the printer head. A supply reel gear having a cylindrical portion is mounted on the same shaft as the supply reel, so as to rotate integrally with the supply reel. The coating tool further includes a take-up reel having an engagement hole supported by a take-up reel shaft and being adapted to take up the transfer tape after use. A take-up reel gear having a cylindrical portion is supported by the same shaft as the take-up reel so as to rotate integrally with the take-up reel. An annular rib is formed on the outer peripheral surface of the cylindrical portion of the supply reel gear or the take-up reel gear so as to surround the cylindrical portion of the corresponding gear. An elastic edging strip is formed on a lower portion of the inner wall surface of the engagement hole of the supply reel or the take-up reel so as to fit between the annular rib and the outer peripheral wall of the cylindrical portion of either the supply reel gear or the take-up reel gear, depending upon the configuration of the coating tool.

The elastic edging strip is formed peripherally on the bottom end of the inner wall surface of the engagement hole of the supply reel so as to hold and engage the cylindrical portion of the supply reel gear, thereby allowing the supply reel to interlock with the supply reel gear. The elastic edging strip is made small in thickness or of a soft material so as to have a sufficient degree of elasticity so that even when the elastic edging strip tends to become deformed by expanding outward, the thermal deformation of the elastic edging strip is prevented since the elastic edging strip fits between the cylindrical portion of the supply reel or the take-up reel and the annular rib formed to surround the cylindrical portion of the supply reel gear or the take-up reel gear. Accordingly, the holding and engagement of the cylindrical portion of the supply reel gear or the take-up reel gear by the elastic edging strip is secured, thereby preventing the idle rotation of the supply reel or the take-up reel with respect to the supply reel gear or the take-up reel gear, respectively. Consequently, the supply reel or the take-up reel and the supply reel gear or the take-up reel gear are made rotatable integrally with each other thereby allowing the delivery and taking-up of the transfer tape to be performed securely.

DETAILED DESCRIPTION

Figure 1:
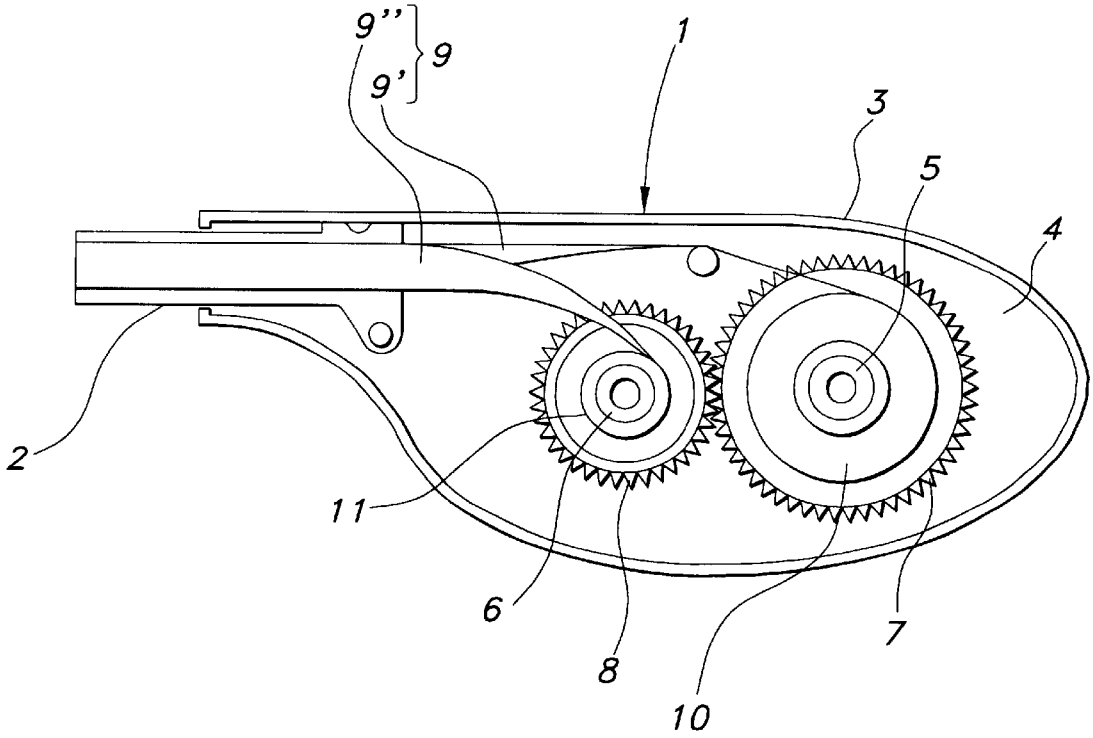
FIG. 1 is a front view of a coating tool according to one embodiment of the present invention.
Figure 2:
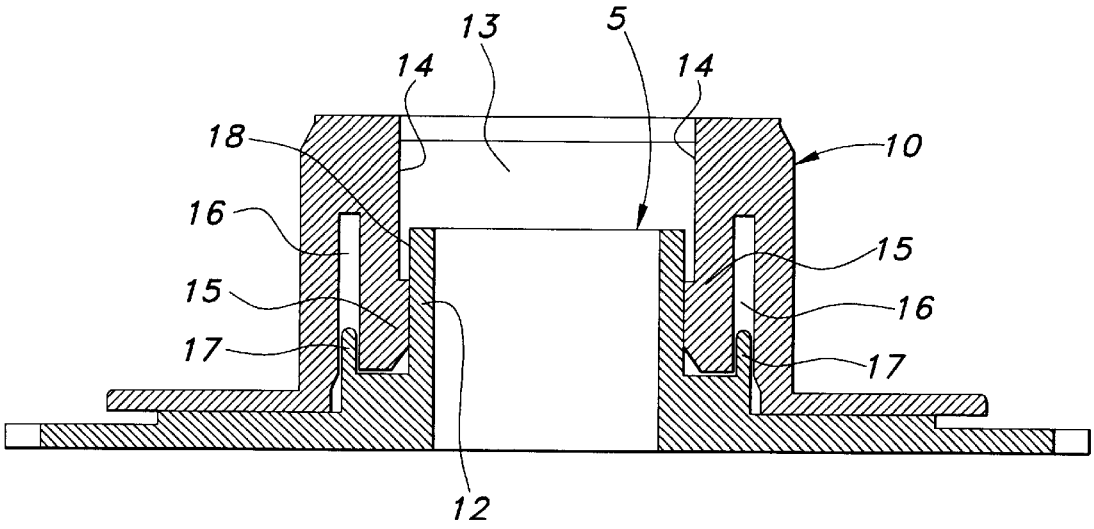
FIG. 2 is a cross-sectional view of a supply reel of the coating tool shown in FIG. 1.

One embodiment of the present invention will now be described by referring to the accompanying drawings.

In the drawings, reference numeral 1 designates a coating tool which comprises a main body 3 having a printer head 2 projecting from an opening formed at the top thereof. The main body 3 houses therein a supply reel shaft 5 and a take-up reel shaft 6, with both being erected integrally from an inner wall surface 4 of the main body 3. A supply reel gear 7 and a supply reel 10, as well a take-up reel gear 8 and a take-up reel 11 are also disposed within the main body 3 of the coating tool 1. The supply reel 10 has an engagement hole 13 and is mounted on the supply reel shaft 5. The supply reel gear 7 has a cylindrical portion 12 and is mounted on the shaft 5, together with the supply reel 10. Both the take-up reel 11 and the take-up reel gear 8 are mounted on the shaft 6. The mechanism of the coating tool 1 is such that a transfer tape 9 wound about the supply reel 10 is delivered to the printer head 2 and when the transfer tape 9 has passed over the printer head 2, it is taken up around the take-up reel 11.

In the above arrangement, according to the illustrative embodiment, the relationship between the supply reel 10 (or the take-up reel 11) and the supply reel gear 7 (or the take-up reel gear 8) is such that an elastic edging strip 15 is formed at the lower portion of the inner wall surface 14 of the engagement hole 13 and a cylindrical gap 16 is disposed radially outwardly of edging strip 15, so that the cylindrical portion 12 of supply reel gear 7 is elastically held and engaged by the elastic edging strip 15. Further, an annular rib 17 is formed around the cylindrical portion 12 of the supply reel gear 7 so as to fit in the cylindrical gap 16. Accordingly, the elastic edging strip 15 is held sandwiched between the outer peripheral wall surface 18 of the supply reel gear 7 and the annular rib 17.

With the previously described structure, when the coating tool 1 is used in the usual manner, the user may carry the coating tool 1 by hand and slide it in a certain direction whereupon an unused transfer tape 9' is delivered from the supply reel 10 to the printer head 2. The unused transfer tape 9' has a paste or a correcting paint adhered to the surface thereof A transfer tape 9" which has become wasted or unavailable due to its passage over the printer head 2 rotates integrally with the take-up reel gear 8 which meshes with the supply reel gear 7, which is mounted on the supply reel shaft 5 together with supply reel 10. Accordingly, the waste transfer tape 9" is wound about the take-up reel 11 which is mounted on the take-up shaft 6 together with the take-up reel gear 8. Consequently, the delivery and taking-up of the transfer tape 9 can be performed smoothly and securely.

Further, even when the transfer tape draw-out speed becomes higher than its set speed due to the application of an excessively strong tensile force on the tape 9 and the supply reel 10 around which the unused transfer tape 9' is wound rotates to an excessive degree, the holding and engagement of the cylindrical portion 12 of the supply reel gear 7 by the elastic edging strip 15 (formed on the inner peripheral wall surface 14 of the engagement hole 13 of the supply reel 10) is released so that the supply reel 10 rotates idly with respect to the supply reel gear 7, both mounted on the supply reel shaft 5. Further, the take-up reel 11 and take-up reel gear 8, which meshes with the supply reel gear 7, also stop rotating during the delivery of the unused transfer tape 9' from the supply reel 10 to the printer head 2 while the supply reel 10 rotates idly with respect to the supply reel gear 7. As a result, no excessive degree of stress is applied to the transfer tape 9, thereby preventing the breakage or cutting of the transfer tape 9.

As discussed previously, the elastic edging strip 15 is formed on the inner peripheral wall surface 14 of the engagement hole 13 of the supply reel 10 and is adapted to hold the cylindrical portion 12 of the supply reel gear 7, so as to allow the supply reel 10 to become interlocked with the supply reel gear 7. The elastic edging strip 15 is made with a small thickness or is made of a soft material so as to have a sufficient degree of elasticity. Therefore, even when the elastic edging strip 15 tends to become thermally deformed by expanding outwardly during the storage and transportation of the coating tool 1 in a high-temperature environment, thermal deformation of the elastic edging strip 15 is prevented since the annular rib 17 of the supply reel gear 7 is disposed within the cylindrical gap 16 formed radially outwardly of the elastic edging strip 15. Accordingly, the holding of the cylindrical portion 12 of the supply reel gear 7 by the elastic edging strip 15 is secured and the idle rotation of supply reel 10 with respect to the supply reel gear 7 is prevented as a result of the coating tool being exposed to a high temperature environment. Consequently, the supply reel 10 and the supply reel gear 7 interlock with one another thereby enabling the delivery and taking-up of the transfer tape 9 to be performed smoothly and securely.

As described above, the deformation of the elastic edging strip 15, formed on the inner peripheral wall surface 14 of the engagement hole 13 of the supply reel 10, can be prevented due to the positioning of the elastic edging strip 15 between the annular rib 17 of the supply reel gear 7 and the outer peripheral wall surface 18 of the cylindrical portion 12 of the supply reel gear 7. This results in various advantages, including an improvement in the durability of the parts such as the supply reel 10 and the like forming the coating tool.

While the foregoing description has set forth the preferred embodiments of the present invention in particular detail, it must be understood that numerous modifications, substitutions and changes can be undertaken without departing from the true spirit and scope of the present invention as defined by the ensuing claims. The invention is therefore not limited to specific preferred embodiments as described, but is only limited as defined by the following claims.

What is claimed is:

1. A coating tool for use in transferring a paste or a correcting paint, adhered to a transfer tape, to a target object, said coating tool comprising:

a main body having an opening formed in a top end thereof and a printer head projecting outwardly from said opening;

a supply reel rotatably mounted on a first shaft within said main body and operably effective for delivering the transfer tape to said printer head, said supply reel having an engagement hole which receives said first shaft, said engagement hole having an inner wall surface, said supply reel further including an elastic edging strip formed on a lower portion of said inner wall surface of said engagement hole;

a supply reel gear mounted on said first shaft and including a cylindrical portion having an outer peripheral wall surface, said supply reel gear further including an annular rib formed on said outer peripheral surface;

a take-up reel rotatably mounted on a second shaft within said main body and operably effective for receiving the transfer tape after it passes over said printer head;

a take-up reel gear mounted on said second shaft and meshed with said supply reel gear;

wherein said elastic edging strip is disposed radially between said outer peripheral wall surface of said supply reel gear and said annular rib.

2. The coating tool as recited in claim 1, wherein:

said supply reel includes a cylindrical gap disposed radially outwardly of said elastic edging strip and said annular rib is disposed in said cylindrical gap.

3. A coating tool for use in transferring a paste or a correcting paint, adhered to a transfer tape, to a target object, said coating tool comprising:

a main body having an opening formed in a top end thereof and a printer head projecting outwardly from said opening;

a supply reel rotatably mounted on a first shaft within said main body and operably effective for delivering the transfer tape to said printer head;

a supply reel gear mounted on said first shaft;

a take-up reel rotatably mounted on a second shaft within said main body and operably effective for receiving the transfer tape after it passes over said printer head, said take-up reel having an engagement hole which receives said second shaft, said engagement hole having an inner wall surface, said take-up reel further including an elastic edging strip formed on a lower portion of said inner wall surface of said engagement hole;

a take-up reel gear mounted on said second shaft and meshed with said supply reel gear, said take-up reel gear including a cylindrical portion having an outer peripheral wall surface, said take-up reel gear further including an annular rib formed on said outer peripheral wall surface;

wherein said elastic edging strip is disposed radially between said outer peripheral wall surface of said take-up reel gear and said annular rib.

4. The coating tool as recited in claim 3, wherein:

said take-up reel includes a cylindrical gap disposed radially outwardly of said elastic edging strip and said annular rib is disposed in said cylindrical gap.

* * * * *